United States Patent [19]

Bostic

[11] 4,335,377

[45] Jun. 15, 1982

[54] MEDICAL ALERT ALARM

[75] Inventor: John S. Bostic, Parma Heights, Ohio

[73] Assignee: Joseph E. Belavich, Plant City, Fla.

[21] Appl. No.: 167,786

[22] Filed: Jul. 11, 1980

[51] Int. Cl.[3] ..... G08B 3/00

[52] U.S. Cl. ..... 340/573; 340/384 E; 340/574; 340/693

[58] Field of Search ..... 340/573, 574, 384 E, 340/693; 367/137, 138

[56] References Cited

U.S. PATENT DOCUMENTS

| | | | |
|---|---|---|---|
| 3,614,763 | 10/1971 | Yannuzzi | 340/573 |
| 3,913,092 | 10/1975 | Klingenberg | 340/573 |
| 4,195,284 | 3/1980 | Hampshire et al. | 340/384 E |

*Primary Examiner*—Glen R. Swann, III

*Attorney, Agent, or Firm*—Burge & Porter Co.

[57] ABSTRACT

A medical alert alarm is provided to enable an individual having a medical problem in the nature of a heart condition to alert bystanders of an impending attack. The alarm includes a compartment for storing medication, as well as means to identify the individual and the nature of the medical problem. An important feature of the invention relates to the small size of a housing used to contain components of the alarm. Very small components, including a small speaker and other audio oscillator circuitry, are used. In order to project an audible signal having desirable alerting characteristics, and still maintain a small housing size, a resonant cavity is employed. The dimensions of the resonant cavity are carefully selected so that the proper audible signal is produced. The invention also includes a clip and a switch positioned such that the alarm can be activated easily.

11 Claims, 6 Drawing Figures

MEDICAL ALERT ALARM

BACKGROUND OF THE INVENTION

1. Field of the Invention

The invention relates to portable alarms and, more particularly, to an exceedingly compact, lightweight alarm especially adapted for use as a medical alert alarm.

2. Description of the Prior Art

Portable alarms per se have been known for some time. Generally speaking, these alarms consist of a battery powered speaker housed in a casing having an external switch. By activating the alarm in the event of imminent or suspected illness, an individual can alert bystanders to the fact of a medical problem and help can be summoned. Other portable devices of this nature are known in which a small radio transmitter carried by the individual can be activated. The signal thus transmitted, upon being received by an appropriate facility such as a hospital or rescue squad, can serve as notice to summon help.

A problem with prior alarm devices relates to their bulkiness. Obviously, the devices must be small enough and light enough to be carried conveniently by individuals. The smallest known medical alert alarms previously available have been about the size of a pack of cigarettes (approximately $2\frac{1}{2}'' \times 3\frac{1}{2}'' \times 1''$). Although the size of the smallest medical alert alarm is considerably smaller than early medical alert alarms, further improvements in size reduction are desired. It is expected that a smaller medical alert alarm not only would be more convenient to carry, thereby encouraging more people to use such alarms, but a smaller alarm should be less expensive because of the need for fewer materials.

A problem with reducing the size of medical alert alarms relates to the audible signal which must be produced. Known medical alert alarms associated with cardiovascular medicine emit a distinctive signal having a frequency of approximately 640 Hertz. The signal produced by prior devices purposefully is quite shrill, and immediately attracts attention to itself and indicates to those nearby that a cardiac standstill has occurred. Unfortunately, devices capable of producing a signal having the proper attention-getting characteristics have been rather bulky. It is believed that prior medical alert alarms have not been smaller because of the size of the components needed to produce a proper medical alert signal.

In view of the foregoing considerations, it is an object of the present invention to provide a medical alert alarm which is exceedingly compact and lightweight.

It is an additional object of the invention to provide a medical alert alarm having audio oscillator circuitry and a resonant cavity adapted to produce a signal having desired medical alert characteristics.

DESCRIPTION OF THE PREFERRED EMBODIMENT

Figure 1:
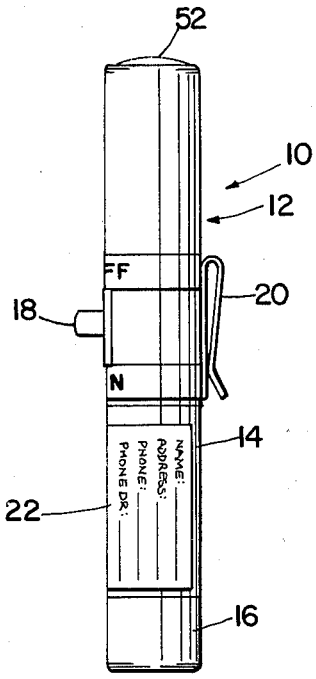
FIG. 1 is a side elevational view of a medical alert alarm according to the invention.
Figure 2:
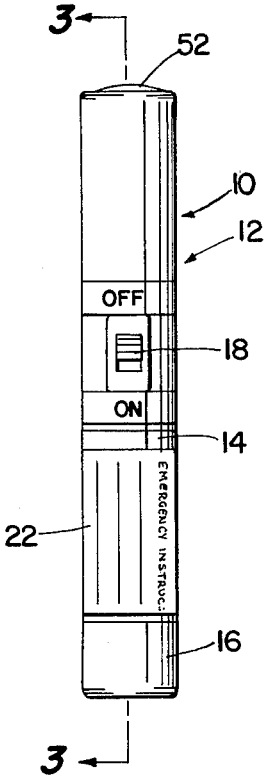
FIG. 2 is a front elevational view of the medical alert alarm of FIG. 1.

Referring to FIGS. 1–5, a medical alert alarm 10 is shown. The alarm 10 is intended to broadcast an audible signal within the range of approximately 630–650 Hertz. The alarm 10 is so constructed that the sound emitted by the alarm 10 imitates that produced by existing alarm equipment used in cardiac medicine.

The alarm 10 includes a housing 12 having a main body portion 14 and a removable end cap 16. The housing 12 is cylindrical and has a diameter of approximately $\frac{5}{8}$ inch. The length of the body portion 14 is approximately $3\frac{1}{2}$ inches, and the end cap 16 is approximately $\frac{1}{2}$ inch in length. It is intended that the housing 12 will be manufactured in a molding operation from a plastics material such as ABS, polystyrene, and the like.

A switch 18 projects outwardly of the housing 12 and is movable between an "on" position in which the alarm 10 is activated, and an "off" position in which the alarm 10 is deactivated. The "off" position is vertically spaced above the "on" position so that, upon pulling the alarm 10 from one's pocket, the alarm 10 will tend to be automatically activated.

The alarm 10 also includes a clip 20 for attaching the alarm 10 to one's pocket, as well as a label 22 upon which a patient's name and telephone number, physician's name, and so forth can be written.

Figure 3:
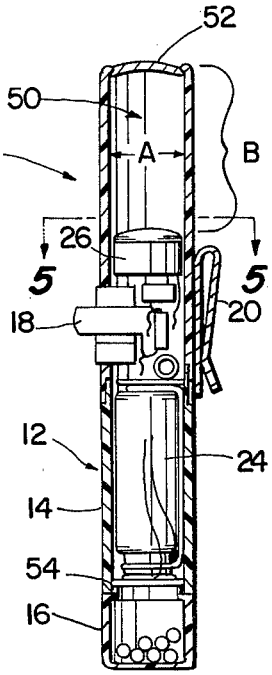
FIG. 3 is a cross-sectional view taken on a plane indicated by line 3—3 in FIG. 2.
Figure 4:
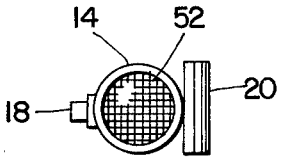
FIG. 4 is an end view of the medical alert alarm of FIG. 1.
Figure 5:
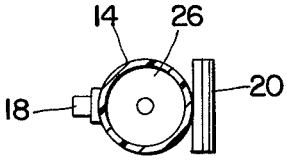
FIG. 5 is a view taken along a plane indicated by line 5—5 in FIG. 3.
Figure 6:
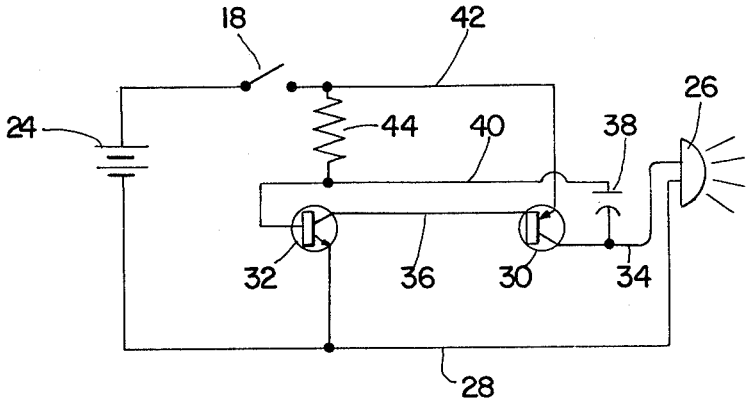
FIG. 6 is a schematic diagram of electrical circuitry according to the invention.

Referring particularly to FIG. 3, the alarm 10 includes a miniature battery 24 for powering the alarm 10. The battery 24 may be a mercury battery manufactured by the Mallory Corporation under the trademark DURACELL, Model TR175 (7 volts). The battery 24 is connected with the switch 18, as well as a number of other electrical and electronic components. Referring also to FIG. 6, the battery 24 is connected in a series with the switch 18. A speaker 26 is connected to the battery 24 by way of a ground line 28. The speaker is commercially available from the Harris Corporation, part No. FA4010429-B. The speaker 26 is powered by transistors 30, 32. The speaker 26 is connected to the transistor 30 by a line 34, while the transistor 30 is connected to the transistor 32 by a line 36. A capacitor 38 is placed in a line 40, one end of which is connected to the line 34, and the other end of which is connected to the transistor 32. A line 42 connects the switch 18 and the transistor 30. A resistor 44 is connected across the line 42 and the line 40. The resistor 44 is approximately 82,000 ohms, while the capacitor 38 is approximately 100 microfahrads. The transistors 30, 32 are manufactured by the RCA Corporation and are identified by part numbers 2N3906 and 2N3904, respectively.

The speaker 26 is positioned in the body portion 14 near the open end of the body portion 14. In order to provide proper aural characteristics, the body portion 14 is configured to provide a resonant cavity 50. The cavity 50 includes a cylindrical wall having a diameter represented by the figure "A" in FIG. 3. Dimension A is 17/32 inch. The length of the resonant cavity 50 is shown in FIG. 3 by the dimension "B." The dimension B is 1 1/16 inches. The open end of the resonant cavity 50 is closed by a grill 52 in the form of a screen. The grill 52 is made of stainless steel wire and its openings are very small, on the order of 1/64 inch by 1/64 inch.

Although the theory of operation of the invention may not be understood perfectly, the size and shape of the resonant cavity 50 are important in producing a tone having desired characteristics to alert bystanders of a medical emergency. A desirable ratio of the dimensions "A" and "B" has been found to be 1:2.

The alarm 10 also includes a pill compartment defined by the end cap 16. The end cap 16 is secured to the body portion 14 by a threaded connection indicated at 54. The pill compartment 16 does not influence the sound emitted by the alarm 10, but it is provided as a convenience to the individual carrying the alarm 10.

It will be appreciated from the foregoing description that a medical alert alarm according to the invention is exceedingly compact and lightweight. The alarm can be carried with virtually no inconvenience to the user, and can be activated easily merely by pulling it from one's pocket. The electrical components associated with the alarm are inexpensive and rugged, and cooperate, along with the resonant cavity, to produce a signal characteristic of a medical emergency.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A portable medical alert alarm comprising:

(a) a housing for carrying electrical components necessary to produce a distinctive signal on the order of 640 Hertz capable of alerting bystanders to the fact of a medical emergency;

(b) audio oscillator circuitry disposed within the housing for producing an aural signal;

(c) a switch extending outwardly of the housing and having on and off positions for activating the alarm, the switch being connected to the audio oscillator circuitry; and, (d) a generally cylindrical resonant cavity included as part of the housing disposed adjacent to the audio oscillator circuitry for amplifying the sound emitted by the alarm, the cavity being located toward one end of the housing and having an open end located at the end of the housing, the ratio of resonant cavity length to diameter being approximately 2:1.

2. The medical alert alarm of claim 1, wherein the resonant cavity has a diameter of approximately 17/32 inch, a length of approximately 1 1/16 inch, and the open end of the cavity is closed by a sound-pervious grill.

3. The medical alert alarm of claim 1, further comprising a clip secured to the housing for convenient attachment of the alarm to one's clothing or effects.

4. The medical alert alarm of claim 3, wherein the on and off positions of the switch are located relative to the clip such that the switch will tend to be moved to the on position upon removing the alarm from one's clothing or effects.

5. The medical alert alarm of claim 1, further comprising a pill compartment included as part of the alarm, the pill compartment being in the form of an end cap secured to the end of the housing remote from the resonant cavity.

6. The medical alert alarm of claim 1, further comprising a label secured to the outside of the housing, the label providing space to display information concerning the person carrying the alarm.

7. A portable medical alarm for announcing to bystanders the fact of a medical emergency, comprising:

(a) a housing have outer dimensions of approximately $\frac{5}{8}$ inch diameter and $3\frac{1}{2}$ inches length;

(b) audio oscillator circuitry disposed within the housing, the circuitry, upon activation, emitting an aural signal on the order of 640 Hertz characteristic of that associated with medical emergencies;

(c) a switch projecting outwardly of the housing for activating the alarm, the switch being connected to the audio oscillator circuitry;

(d) a clip secured to the housing for convenient attachment of the alarm to a person's clothing or effects;

(e) a resonant cavity included as part of the housing disposed adjacent the circuitry and into which the aural signal is projected, the resonant cavity having a ratio of cavity length to diameter of approximately 2:1, the cavity being located toward one end of the housing and having an open end located at the end of the housing; and (f) a grill for closing the open end of the resonant cavity, the grill being pervious to sounds emitted by the circuitry.

8. The medical alert alarm of claim 7, wherein the length of the resonant cavity is approximately 1 1/16 inch and the diameter of the cavity is approximately 17/32 inch.

9. The medical alert alarm of claim 7, further comprising a pill compartment secured to the housing at that end of the alarm remote from the resonant cavity.

10. The medical alert alarm of claim 7, further comprising a label secured to the outside of the housing, the label providing means for displaying medical information about the person carrying the alarm.

11. The medical alert alarm of claim 7, wherein the switch includes on and off positions for activating the alarm, and wherein the on and off positions of the switch are located relative to the clip such that the switch will tend to be moved to the on position upon removing the alarm from one's clothing or effects.

* * * * *